United States Patent [19]

Sabins

[11] Patent Number: 4,468,310

[45] **Date of Patent: * Aug. 28, 1984**

[54] ALUMINUM MARINE ANODE WITH CORE ACTIVATOR

[75] Inventor: Rolland C. Sabins, Lakeside, Calif.

[73] Assignee: Sabins Industries, Inc., San Luis Rey, Calif.

[ * ] Notice: The portion of the term of this patent subsequent to Mar. 4, 1997 has been disclaimed.

[21] Appl. No.: 517,989

[22] Filed: Jul. 28, 1983

Related U.S. Application Data

[60] Division of Ser. No. 707,675, Jul. 22, 1976, abandoned, which is a continuation-in-part of Ser. No. 512,108, Oct. 4, 1974, abandoned.

[51] Int. Cl.[3] ..... C23F 13/00

[52] U.S. Cl. ..... 204/197; 204/286; 204/297 R; 339/263 R

[58] Field of Search ..... 204/147, 148, 196, 197, 204/286, 297 R; 339/263 R

[56] References Cited

U.S. PATENT DOCUMENTS

| | | | |
|---|---|---|---|
| 2,910,421 | 10/1959 | Sabins | 204/197 |
| 3,191,140 | 6/1965 | Coldren | 339/263 R |
| 3,232,857 | 2/1966 | Caldwell | 204/197 |
| 3,553,094 | 1/1971 | Scott | 204/197 |
| 3,870,615 | 3/1975 | Wilson et al. | 204/197 |
| 4,191,625 | 3/1980 | Sabins | 204/197 |

*Primary Examiner*—T. Tung

*Attorney, Agent, or Firm*—Trask & Britt

[57] ABSTRACT

An aluminum marine anode is constructed in association with exposed activator surfaces. The surfaces are preferably provided by casting the aluminum anode with a partially exposed core of activator material in place and suitably configurated to provide good conductive contact between the aluminum and the activator. Materials which exhibit a surface potential less negative than about −300 millivolts with respect to a silver-silver chloride half cell function as activators, copper being preferred. Aluminum alloyed with zinc and tin is the preferred anode material.

8 Claims, 6 Drawing Figures

ALUMINUM MARINE ANODE WITH CORE ACTIVATOR

RELATED APPLICATIONS

This application is a division of Ser. No. 707,675, filed July 22, 1976 (now abandoned) which was a continuation-in-part of Ser. No. 512,108 filed Oct. 4, 1974 (now abandoned). It is related to Ser. No. 17,051 filed Mar. 2, 1979 (now U.S. Pat. No. 4,191,625) which application was also a continuation-in-part of said Ser. No. 707,675. All of the foregoing patent applications and patent are commonly assigned with this application.

BACKGROUND OF THE INVENTION

1. Field:

This invention pertains to the cathodic protection of metallic surfaces. It is specifically directed to such systems including marine aluminum alloy anodes directly coupled to the structure. It provides a new assembly of components, which may be embodied in an anode structure, whereby the surface of the anode is maintained sacrificial.

2. State of the Art:

Corrosion of metallic structures exposed to either a marine or soil environment has been a notable problem in the arts utilizing such structures. A great deal of research has been conducted in the public and private sectors involving the cathodic protection of various structures, for example, ship hulls and underground pipes. Various types of impressed current systems have been employed with considerable success but have the attendant disadvantage of high construction, installation and maintenance costs. Direct-coupled sacrificial anodes offer the advantages of low cost for construction and installation as well as relatively low maintenance. Such anodes are effective for a time but tend to develop passive coatings which alter their surface potentials. The United States Bureau of Ships has developed a direct-coupled zinc anode of high purity zinc metal, known as Military Specification MIL-A-18001 which is presently regarded as the best available. Even this high purity anode, when directly coupled to a steel ship, tends to develop inert coatings on its surfaces after only a few weeks of exposure to sea water. The surface potential of the zinc is thereby lowered so that the anode becomes ineffective in protecting a ship's hull from corrosion. It is estimated that currently, sacrificial zinc anodes of one type or another are used in connection with in excess of 90 percent of the world's shipping.

Illustrative of the art generally dealing with sacrificial anodes, and in some cases zinc anodes in association with copper structures, are U.S. Pat. Nos. 3,726,779 (Morgan); 3,485,741 (Booker); 3,425,925 (Fleischman); 1,984,899 (Smith); 3,048,535 (Sabins); 2,619,455 (Harris et al); 3,260,661 (Kemp et al); 3,047,478 (Marsh et al); 3,772,179 (Beer); 3,567,676 (Herrigel et al); and 2,779,729 (Jorgensen); and British Pat. Nos. 11,216 (Morison); 3205 (Casperson); and 852,154.

SUMMARY OF THE INVENTION

The present invention provides both a novel assemblage, preferably embodied as an anode assembly, and a system which utilizes the anode assembly (or its equivalent) to prevent the formation of an inhibitive coating on the surface of the anode. Although the invention is applicable generally to metallic structures exposed to corrosive electrolytic environments, whether underground, in contact with soil electrolytes, or in marine environments, it will be described herein with particular reference to ferrous—e.g., iron or steel, hulled ships in sea water.

In general, the preferred anode assembly of this invention comprises a mass of sacrificial marine aluminum alloy metal, for example, of the Kaiser Aluminum Alloys KA-46, KA-90 or similar composition, in both physical and electrical contact with a suitable activator material. As used herein, the term "anode" is applied to the sacrificial portion of the assembly; i.e., the mass of marine alloy itself, not including the activator or other structural components of the anode assembly. In most embodiments, the activator material is selected with regard to both its electrical and physical properties. Ideally, the activator is sufficiently rigid and strong to be worked into the forms required for an element of the structural mounting of the anode to the ship's hull. Moreover, it has been determined that for use with steel hulls, the surface potential of the activator should be no more negative than −400 millivolts with respect to a silver-silver chloride half cell.

It has become conventional practice in the cathodic protection art, particularly as applied to the protection of steel hulls, to measure surface potentials of materials with respect to a silver-silver chloride half cell standard. On this basis, the surface potential of zinc of high purity is measured at approximately −1,030 millivolts and the surface of the steel is approximately −630 millivolts. The potential difference between zinc and steel or iron is thus only approximately 400 millivolts which is known to be inadequate to avoid the inhibitive process inherent with even high purity zinc. Experience has shown that maintaining a potential difference of 750 millivolts or higher between the zinc and another metal forming a couple with zinc provides sufficient electrical potential to cause the surrounding zinc surfaces to continue to go into solution. By maintaining the solution process active, new atoms of zinc metal are constantly exposed to the electrolyte. There results a certain attritional loss of the anode material, but this loss is relatively minor due to the greater attritional loss to the other metal in the couple.

Similarly, the surface potential of certain special aluminum alloys falls within the range of −1,000 millivolts and −1,300 millivolts with respect to a silver-silver chloride half cell. Such alloys are classified as marine alloys when they also exhibit the chemical and physical properties desired for use in marine environments. These alloys offer a potential difference with respect to a steel or iron hill comparable to that available with high purity zinc, and experience an inhibiting process similar to that of zinc. The use of an activating couple is thus useful with the marine aluminum alloys to maintain the sacrificial solution process active. It has been found, however, that the yield, (which may be defined as the number of ampere hours of cathodic protection available in each pound of anode material consumed) of these aluminum alloys is substantially greater than is high purity zinc. The following table lists pertinent information concerning several marine aluminum alloys available from the Kaiser Aluminum Company, Oakland, Calif.

| ALLOY DESIG-NATION | ALLOY-ING METALS | POTENTIAL WITH RESPECT TO AC/AGCL HALFCELL | YIELD Ampere hours/lb |
|---|---|---|---|
| KA-95 | Hg | 1050 | 1,250 |
| KA-46 | Zn, Sn | 1080 | 1,000 |
| KA-90 | Zn, Sn | 1030 | 1.230 |
| KA-804 | Sn, (Unknown) | | |

The presence of mercury is regarded as undesirable in marine applications. The marine alloys of aluminum with zinc and tin are thus the preferred materials for use in accordance with this invention. The KA-804 alloy offers no special advantage over high purity zinc and exhibits a similar yield. Alloys similar to KA-90 are regarded as ideal for outside ship bottoms with painted surfaces, largely because higher surface potentials tend to cause strippage of paint from painted surfaces. For deep tanks, drilling rigs and unpainted areas, where paint stripping is not a consideration, alloys similar to KA-46 are generally preferred.

Activator materials suitable for use with the anodes of this invention should have a potential difference between their surface potential and that of the anode at least 200 millivolts greater than the corresponding potential difference between the anode and the structure to be protected. When the structure is of steel, suitable activators are generally those which are no more negative on the aforementioned scale than −400 millivolts. Preferably, the activator should be substantially less negative, more on the order of −300 millivolts or less, to achieve the 750 millivolt potential difference observed to be the magnitude of the operating potential difference required to insure continuous attrition of the aluminum alloy surface. Certain copper-tin alloys (e.g., bronzes) can be utilized, although they exhibit a potential difference with respect to aluminum of only approximately 700 millivolts. Accordingly, the activation provided by their use is "borderline" from the standpoint of this invention. Nevertheless, even this level of activation is very helpful in inhibiting or delaying the deposition of an inactive surface on the anode. A potential difference of less than 600 millivolts is generally unsatisfactory. From most standpoints, copper is an ideal material, exhibiting approximately −220 millivolts of surface potential, although many other materials could be used were it not for their expense or undesirable physical properties. For example, monel, silver and platinum are all operable, but impractical because of cost.

The presently preferred activator material for use with this invention is copper because of its good mechanical properties and its adequate surface potential. A "red bronze" alloy of copper, containing on a weight basis, about 3 percent zinc, 6½ percent tin and 1½ percent lead, is presently regarded as an ideal activator material. Monel, while operable, is generally too expensive. Either carbon or lead activators may be employed. Less exposed surface is required for such activators than when copper is used. Moreover, in each instance, these materials tend to drive electrons from the surface of aluminum to an extent which causes unduly rapid activator-induced attrition from the anode surface. By "activator-induced attrition" is meant weight loss of anode metal in excess of the galvanic metal loss attributable to protection of the ship's hull. Sacrificial metal loss due to the galvanic couple of an anode and the ship's hull varies considerably, depending upon factors such as ship speed, temperature and salinity of the water, composition of the anode, etc., but in any event is distinguishable from the attrition of anode metal due solely to the activator itself. While some activator-induced attrition is desirable to maintain the anode sacrificial in its galvanic couple with the ship, the ratio of exposed surface areas of activator to anode metal, respectively, is desirably selected to maintain the annual activator-induced attrition rate (weight loss) of the anode to below about 10 percent, preferably between about 1 percent and 5 percent.

A typical anode of this invention is expected to be in service for two years. Initially the activator-induced attrition rate will be lower, usually about 1 to 3 percent. By the end of its service life, the activator-induced attrition rate will normally have increased to as high as about 5 to 10 percent due to the changing surface ratios of anode to activator as attrition proceeds. The activators and anodes can be shaped to counteract this tendency, but normally the increased attrition rate is desirable to balance the inherent increased tendency of the zinc surface to become passive (probably because of concentrating impurities). Hence, the anode configuration shown in the drawings is highly preferred. The ratio of exposed surface areas of activator to anode alloy, respectively, is desirably selected to maintain the attrition rate of the anode to below about 10 percent, preferably between about 1 percent and 5 percent.

The mode of operation of this invention may be explained as follows, although the specific mechanism involved is of no consequence except as an assistance in calculating the amount of surface area of anode required to suitably protect a particular structure in a particular environment. Assuming an array of KA-90 marine aluminum anodes with copper activator structures cast in place with exposed surfaces, the copper is in intimate physical and electrical contact with both the KA-90 alloy and the sea water environment. The potential difference between the KA-90 alloy and the copper surfaces is approximately 810 millivolts, which tends to drive electrons from the surface of the alloy to the surface of the copper. Ultimately, the two surfaces would tend to equalize in potential, except that the surface potential of the copper activator becomes so negative with respect to its normal surface potential that electrons are emitted to the sea water. As a consequence, a continuous flow of electrons from the alloy surface to the copper is maintained. In this fashion, new metal atoms from the alloy are continuously exposed, maintaining the active surface potential of the KA-90 alloy at approximately −1,030 millivolts. Concurrently, electrons are migrating to the ship's hull, providing additional loading on the anodes. But for the copper activator surfaces, the surface potential of the hull adjacent the anode would ultimately approximate that of the KA-90 alloy, thereby inhibiting the activity of the anode surface rather than activating it.

Generally, when copper is used as the activator surface, each standard KA-90 alloy anode (containing approximately 19 pounds of KA-90 alloy) used in sea water in a galvanic direct couple to a steel or iron hull will protect approximately 500 square feet of wetted surface and will deliver a minimum of approximately 23000 ampere hours of protective current per year (approximately 5 milliamps per square foot). Under these conditions, each anode will sacrifice, through attrition from its surface, an average of about 0.06 lbs. of alloy metal annually. A typical standard anode has a surface area of approximately 1¾ square feet, so that under the aforedescribed conditions, the ratio of anode surface to hull surface is approximately 1 to 300.

A special mounting assembly is provided in accordance with this invention whereby anodes may conveniently be exchanged without welding. Thus, anodes may be replaced by divers without dry docking the ship if desired. The mounting is structured so as to maintain positive physical and electrical coupling between the aluminum alloy anode material through a continuous mass of metal structure, including the activator core material, to the ship's hull. Ideally, the anodes are formed as cylindrical bars cast around cylindrical cores and are of standardized lengths to facilitate interchangeability. It has been found that attrition of such anodes in use tends to proceed primarily from the ends toward the middle.

BRIEF DESCRIPTION OF THE DRAWINGS

In the drawings which illustrate what is presently regarded as the best mode for carrying out the invention.

DESCRIPTION OF THE ILLUSTRATED EMBODIMENT

Figure 1:
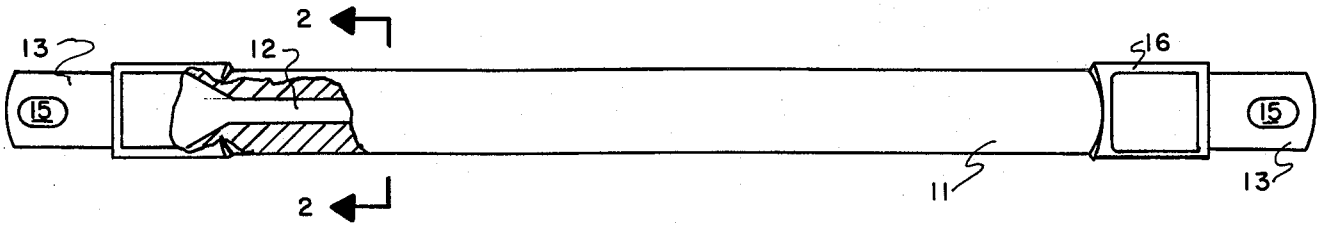
FIG. 1 is a plan view, partially in section, of a preferred form of this invention, wherein marine aluminum alloy is cast with a copper core in place within the anode.
Figure 2:
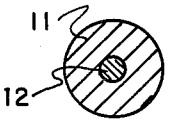
FIG. 2 is a view in section along the section line 2—2 of FIG. 1 viewed in the direction of the arrows.
Figure 3:
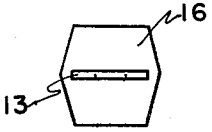
FIG. 3 is an end view of the anode of FIG. 1.

The anode illustrated by FIGS. 1 through 3 comprises a mass 11 of marine aluminum alloy metal, preferably KA-90 alloy cast around a copper rod core 12, embedded in the mass of alloy as best seen from FIG. 2. End portions 13 of the core 12 extend as mounting lugs, each of which is provided with a hole 15 adapted to register with appropriate pins or bolts of mountings (FIGS. 4–6) fastened to the hull of a ship or other structure (not shown) it is desired to cathodically protect. The exposed surfaces of the lugs 13 provide an initial activating surface which normally suffices, without more, to retain the aluminum alloy anode mass 11 sacrificial. As attrition of the alloy 11 proceeds, the surface area of the lugs is inevitably supplemented by the exposure of increasing portions of the activator core 12.

The anode metal mass 11 may be formed in various shapes, but preferably takes the anode shape shown. This shape has been found advantageous for core-activated anodes generally whether of the zinc type claimed in the aforementioned patent application Ser. No. 512,108, the disclosure of which is incorporated by reference herein, or the marine aluminum alloy type disclosed herein. As shown, each anode has somewhat enlarged end portions 16 extending a few (in the illustrated instance, about 3) inches in length, and generally about 2½ to about 3 inches at their widest transverse dimensions (FIG. 3).

The remaining length of the anode mass 11, usually about 20 inches to about two feet (in the illustrated instance, 22½ inches), is of circular cross-section. The enlarged ends 16 accommodate the flattened extensions 13 of the core 12. As illustrated, the core 12 is a copper rod about ⅝ inch in diameter, and the annular alloy anode 11, has an outer diameter of about 2 5/16 inches. This construction provides an initial exposed surface ratio of anode to core of about 8:1. As attrition proceeds under use conditions, this ratio decreases until it ultimately approaches 1:1. In practice, the initial ratio of exposed surfaces may be selected within the range of about 5:1 to about 15:1, although the most useful initial ratio when copper cores are utilized appears to fall within about 7:1 to about 10:1.

Anodes of the type illustrated may be standarized to be readily replaced on standardized mountings. A representative standard fresh anode of this type would include approximately 250 square inches exposed anode surface, 19 lbs. of KA-90 marine aluminum alloy metal, approximately 22½ square inches of exposed activator surface, and approximately 4½ lbs. of copper core material.

The copper cores 12 provide all of the activator surface required by the anode and cathodic protection systems of this invention. It is to be understood that other materials such as lead or carbon might be substituted for the copper cores illustrated, although steps would then need to be taken to reduce the exposed surface area of these materials as well as to provide for rigidity and suitable structural properties of the overall assembly. It is particularly desirable that the copper cores be mounted in such a manner that there is electrical continuity by direct coupling between the mounting lugs 13 and the steel hull.

As used herein and in the claims, the term "direct coupling" refers to physical contact between two metallic surfaces sufficient to provide electrical conduction across a substantial surface area of the two materials, as opposed to through a wire or cable conductor interconnecting the two materials. Such coupling may be through intermediate metallic surfaces, such as those inherent in a mounting assembly.

Figure 6:
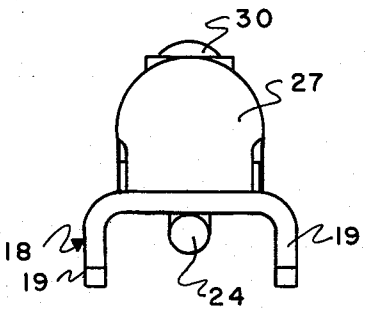
FIG. 6 is an end view of the mounting of FIGS. 4 and 5.
Figure 5:
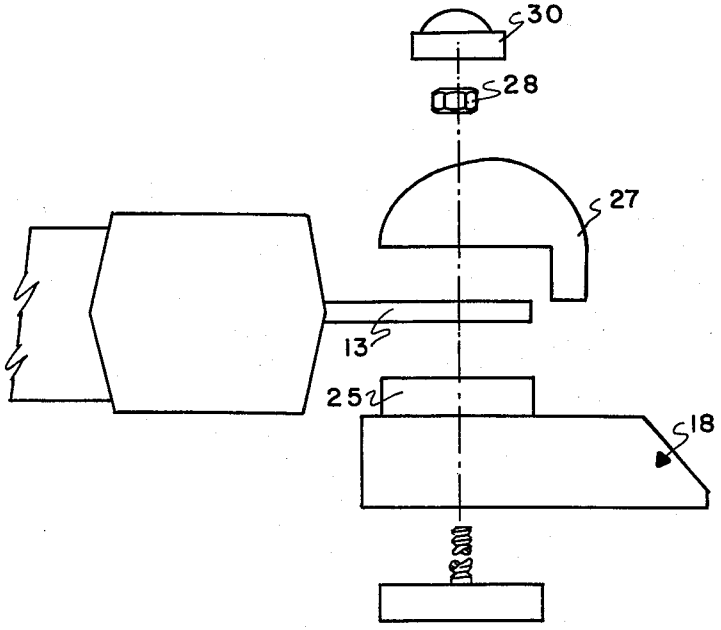
FIG. 5 is an exploded side elevation view of the mounting of FIG. 4.
Figure 4:
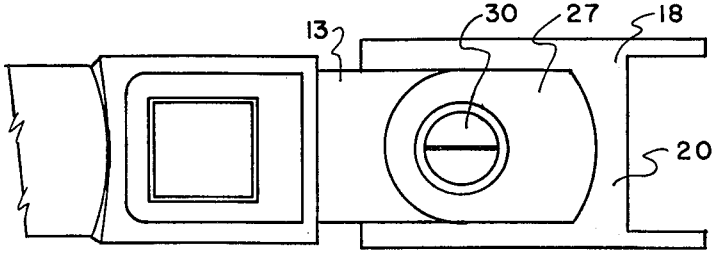
FIG. 4 is a top plan view of a mounting assembly for this invention.

A highly preferred mounting assembly is illustrated by FIGS. 4, 5 and 6, from which it may be seen that a steel foundation base 18, in the form of a bracket with opposed sides 19 and a slotted top 20, is adapted for welding directly to a ship's hull. A tee bolt 24, preferably of forged steel, is received between the sides 19 of the base 18 and extends up through the slotted top 20 and through the hole 15 in the anode mounting lug 13. The lug 13 rests atop a pad 25, which may be a brass or bronze washer, silver soldered or oven brazed to the base 18. A specially configurated top washer 27, preferably of brass or bronze, slips over the threaded end of the tee bolt, and a nut 28 presses the assembly together to assure direct physical coupling between the lug 15, the pad 25, the base 18 and the hull (not shown). The nut 28 is covered with a plastic cap 30. To exchange anodes, it is merely necessary to remove the cap 30 and nut 28, slip off the top washer 27 and lift the anode from the mountings. No welding or other elaborate dry dock procedures are required.

As is well known in the art pertaining to cathodic protection of metallic structures in a marine environment, even the high purity Military Specification zinc anodes preferred by the art will at some point during their first several months in sea water develop a surface coating which actually inhibits or lowers the surface potential of the zinc to lower in the galvanic series than the surrounding ship surfaces. At that time, the zinc no longer serves or functions as an anode to the ship but becomes cathodic with respect to the ship, thereby causing the ship to function as an anode in the region around the zinc anode. Inspection of zinc anodes during annual docking of ships has revealed a measured surface potential as low as −300 or −400 millivolts with respect to a silver-silver chloride half cell compared to the normal potential of −1,030 millivolts. A similar phenomenon occurs when marine aluminum alloy anodes are used in place of zinc anodes. Use of the activating cores taught by this invention in the cathodic protection system provides sufficient voltage differential between the alloy and the bus bars to destroy the resistive or inhibiting coatings normally developed by the anode in use.

The anodes of this invention are best embodied as an array arranged in number and location to provide cathodic protection to a steel or iron ship's hull. The number of anodes required in a given array depends on several factors, including the wetted surface area of the hull. This area is typically determined by a rigorous formula related to the type of hull involved. For example, the wetted surface area of a well streamlined hull, such as a C-4 cargo ship, is regarded as the sum of sixty percent of the product of the length and beam dimensions plus a factor of 1.7 times the product of the length and depth dimensions (i.e., $L \times D \times 1.7 + L \times B \times 0.6 =$ wetted surface). Similar formulas have been worked out for various shapes of hulls. Given the wetted surface area the number and placement of anodes in the array may be determined.

Desirably, each of the anodes of this invention is associated with between about 100 and about 1300 square feet of wetted surface area, giving an initial anode-to-hull surface area ratio of between about 1:50 and about 1:750.

Reference herein to details of the illustrated embodiments should not be taken as limiting the scope of the appended claims, which themselves recite those features regarded as essential to the claimed invention.

I claim:

1. Structure within an array of marine anodes connected cathodically to protect a ferrous surface exposed to brine comprising:

a metallic base physically coupled to said ferrous surface including spaced, upstanding sides and a top;

a tee bolt between said upstanding sides with a threaded shank extending up through said top;

a non-ferrous metallic mounting pad physically coupled to said top and surrounding said threaded shank, constituting means for direct coupling to a mounting lug of a marine anode;

top washer means cooperatively adapted with said mounting pad to clamp said mounting lug therebetween; and a nut for said threaded shank constituting means for pressing said top washer down towards said mounting pad and pressing said tee bolt into firm engagement with said top.

2. Structure according to claim 1, including:

an array of individual anodes of sacrificial metal having a surface potential measured with respect to a silver-silver chloride half cell more negative than about −1,000 millivolts in direct contact with said brine and mounted in direct coupling with said ferrous surface;

each said anode including a structurally rigid core carrying a pair of mounting lugs, each of which is directly coupled to a said mounting pad by means of said tee bolt and said nut.

3. Structure according to claim 2 wherein the potential difference between the surface of said core and said sacrificial metal is at least about 200 millivolts.

4. Structure according to claim 2 wherein said core is constructed from material having a surface potential less negative than bronze on the galvanic series of potentials measured with respect to a silver-silver chloride half cell.

5. Structure according to claim 2 wherein the core is constructed from copper.

6. Structure according to claim 2 wherein said sacrificial metal comprises aluminum, zinc and tin.

7. Structure according to claim 6 wherein said core comprises copper.

8. Structure according to claim 7 wherein said sacrificial metal offers a yield in ampere hours per pound approximately equivalent to that of KA-90 marine aluminum alloy.

* * * * *

UNITED STATES PATENT OFFICE

CERTIFICATE OF CORRECTION

Patent No. 4468310 Dated August 28, 1984

Inventor(s) Rolland C. Sabins

It is certified that error appears in the above-identified patent and that said Letters Patent are hereby corrected as shown below:

Col. 2, line 55 change "hill" to ---hull---.

Signed and Sealed this

Ninth Day of April 1985

[SEAL]

*Attest:*

DONALD J. QUIGG

*Attesting Officer* *Acting Commissioner of Patents and Trademarks*